United States Patent [19]

Skinner

[11] 4,202,308

[45] May 13, 1980

[54] INTERNAL COMBUSTION ENGINE SYSTEM

[75] Inventor: Barrie C. Skinner, Isleworth, England

[73] Assignee: Lucas Industries Limited, Birmingham, England

[21] Appl. No.: 919,977

[22] Filed: Jun. 28, 1978

[30] Foreign Application Priority Data

Jul. 13, 1977 [GB] United Kingdom ..... 29364/77

[51] Int. Cl.[2] ..... F02N 17/00; F02M 31/00

[52] U.S. Cl. ..... 123/179 G; 123/179 H; 123/180 R; 123/122 E; 123/122 F

[58] Field of Search ..... 123/179 G, 179 L, 180 R, 123/122 E, 122 F, 179 H, 139 AS; 60/601

[56] References Cited

U.S. PATENT DOCUMENTS

| | | | |
|---|---|---|---|
| 2,905,165 | 9/1959 | Hall | 123/179 G |
| 2,995,890 | 8/1961 | Dolza | 123/180 R |
| 3,091,282 | 5/1963 | Curzon | 123/180 R |
| 3,353,520 | 11/1967 | Haag | 123/179 H |
| 3,379,184 | 4/1968 | Wolf | 123/179 H |
| 3,620,424 | 11/1971 | Grigsby | 123/180 R |
| 3,767,173 | 10/1973 | Ishii | 123/179 G |
| 3,872,851 | 3/1975 | Matsumoto et al. | 123/180 R |
| 3,943,901 | 3/1976 | Takahashi et al. | 123/139 AS |

*Primary Examiner*—Ronald H. Lazarus
*Assistant Examiner*—M. Moy

[57] ABSTRACT

An engine system includes a starting aid which is mounted in the air inlet manifold of the engine and is supplied with fuel from a fuel chamber to assist starting of the engine. The engine includes a fuel injection nozzle which is supplied with fuel at high pressure by means of a pump. The leakage fuel from the nozzle is utilized to recharge the chamber with fuel during running of the engine and the chamber is provided with an overflow connection back to a source of fuel.

12 Claims, 4 Drawing Figures

INTERNAL COMBUSTION ENGINE SYSTEM

This invention relates to an internal combustion engine including a starting aid system and to a fuel supply device forming part of such a system.

According to the present invention there is provided an internal combustion engine including a starting aid system, the starting aid system comprising a starting aid device mounted on an air inlet manifold of the engine and including a fuel inlet, a fuel outlet to which in use fuel can flow from the fuel inlet to be admitted to said inlet manifold and means for vapourising and igniting the fuel flowing through the fuel outlet, the fuel supply device including a fuel chamber having an air inlet connected to said inlet manifold, a fuel inlet adapted to be connected to a fuel source, a fuel outlet connected to the fuel inlet of the starting aid device and valve means arranged to control communication between the air inlet, the fuel inlet and the fuel chamber, the valve means in a first position permitting communication between the fuel inlet and the fuel chamber but closing communication between the air inlet and the fuel chamber, and in a second position permitting communication between the air inlet and the fuel chamber so that air pressure in said inlet manifold is communicated to the fuel chamber but closing communication between the fuel inlet and the fuel chamber, and further valve means arranged to control communication between the fuel chamber of the fuel supply device and the fuel outlet of the starting aid device such that communication therebetween is permitted when the first-mentioned valve means is in its second position.

Preferably the further valve means forms part of the starting aid device and is arranged to control communication between the fuel inlet and the fuel outlet thereof.

Conveniently, the air in said inlet manifold is pressurised by means of a compressor which may be in the form of a turbo-charger powered by exhaust gases flowing in an exhaust manifold of said engine.

In one particular arrangement, said engine is of the direct fuel injection type and said fuel source is constituted by leakage from a plurality of fuel injection devices.

Also according to the present invention, there is provided a fuel supply device for an internal combustion engine starting aid, comprising a body defining a fuel chamber having a first inlet for connection to an inlet manifold of said engine, a second inlet for connection to a fuel source and an outlet for connection to said starting aid, valve means for controlling communication between the inlet and the fuel chamber, the valve means in a first position permitting communication between the second inlet and the fuel chamber but preventing communication between the first inlet and the fuel chamber and in a second position permitting communication between the first inlet and the fuel chamber but preventing communication between the second inlet and the fuel chamber.

Preferably, the fuel chamber has a further outlet and the valve means is arranged also to control communication between the further outlet and the fuel chamber so that such communication is permitted when the valve means is in its first position but is prevented when the valve means is in its second position, the further outlet being disposed above the second inlet when the fuel chamber is in use.

Conveniently, the second inlet and the further outlet are connected together by means of a passage in a body which defines the fuel chamber, said passage by-passing the valve means.

The body can be formed in two parts, the fuel chamber, the inlets and outlets being provided in one part and the other part having an actuator for the valve means. The actuator is preferably a solenoid.

Advantageously the body has a bore therein into which the first and second inlets and the further outlet open and the valve means comprises a spool slidable axially of the bore and configurated so as to block the opening of the first inlet when the valve means is in its first position and to block the openings of the second inlet and the further outlet when the valve means is in its second position.

An embodiment of the present invention will now be described by way of example, with reference to the accompanying drawings in which.

Figure 1:
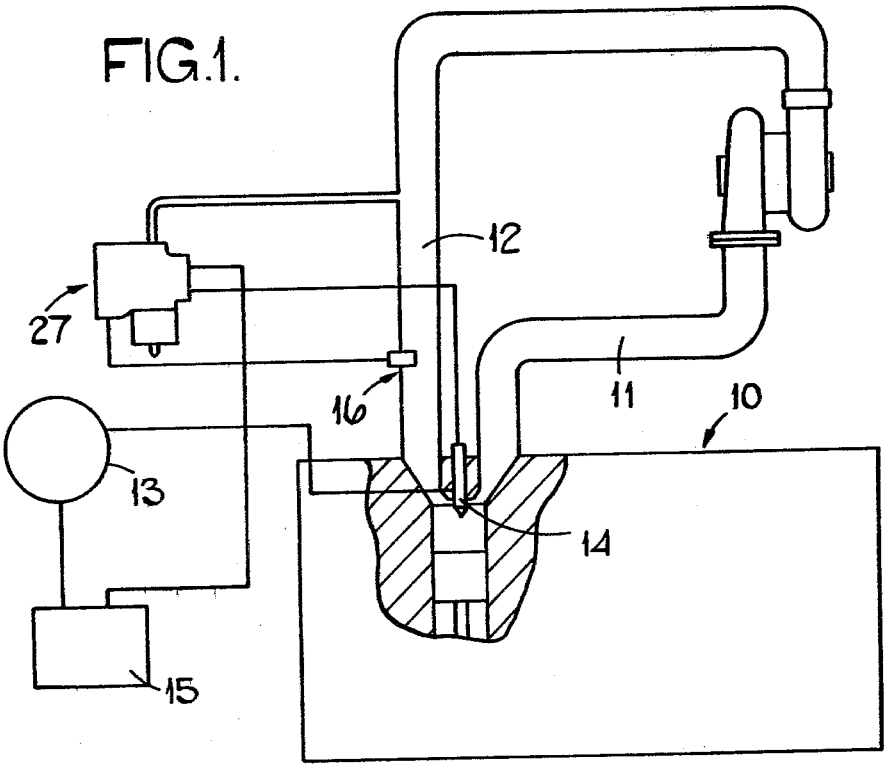
FIG. 1 is a schematic diagram of an internal combustion engine including a starting aid system according to the present invention.

Referring firstly to FIG. 1 of the drawings, there is generally indicated at 10, an internal combustion engine of the compression ignition type and which is provided with an exhaust manifold 11 and an air inlet manifold 12, the two manifolds being shown directly in communication with a combustion chamber of the engine with the usual exhaust and inlet valves omitted for the sake of clarity. The exhaust manifold 11 is connected to an inlet of a turbine of a turbo-supercharger which includes a compressor the outlet of which is connected to the air inlet manifold 12.

The engine is also provided with a fuel system which includes a high pressure fuel pump 13 driven in timed relationship with the engine and which supplies fuel in turn to a plurality of injection nozzles one of which is indicated at 14 and positioned to direct fuel into a combustion space of the engine at the appropriate instant. The fuel pump draws fuel from a tank 15 and in practice there will be provided intermediate the tank and the fuel pump, at least a filter and probably a low pressure lift pump. The operation of the apparatus thus far described is well known.

Figure 2:
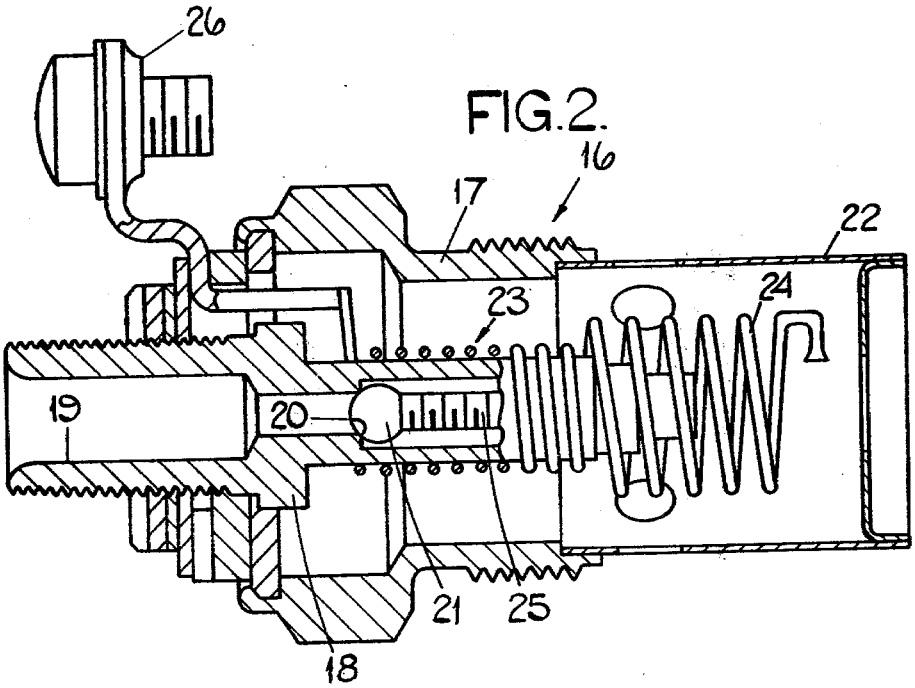
FIG. 2 is a sectional side view of a starting aid device which forms part of the system of FIG. 1.

In order to facilitate the starting of the engine, there is mounted in the air inlet manifold a starting aid which is generally indicated at 16 and which is shown in sectional side elevation in FIG. 2. The starting aid includes a hollow body 17 having a threaded portion whereby it can be secured in the air inlet manifold. The body portion 17 mounts a central tubular part 18 which at one end defines a fuel inlet 19. Within the central body 18 is formed a seating 20 against which a valve member in the form of a ball can act to prevent flow of fuel from the inlet 19 to an outlet which opens into a tubular extension 22 of the body 17. Surrounding the central body 18 is a heating element which conveniently is formed in two portions 23, 24 the part 23 serving to heat when the element is energised, the central body 18 and portion 24 being arranged to ignite vapourised fuel which leaves the outlet. The ball 21 is held in contact with the seating 20 by means of a rod member 25 which has a coefficient of thermal expansion different to that of the body 18. The arrangement is such that when the heating element is energised the relative expansion of the member 25 and the body 18 is such as to allow the ball 21 to be moved away from the seating by the action of fuel in the inlet 19. When this occurs, the fuel flows to the outlet and in so doing it is vapourised so that it issues from the outlet as a vapour and this vapour is ignited by the portion of the element 24. The ensuing flame within the air inlet manifold acts to heat the air flowing to the engine thereby to facilitate starting of the engine. As will be seen, one end of the element is connected to the tubular extension 22 and the other end is connected to a terminal 26.

Fuel is supplied to the starting aid from a fuel supply device 27 which includes a supply tank. The fuel supply device is positioned at a level higher than the starting aid so that fuel can flow to the starting aid under the action of gravity.

Figure 3:
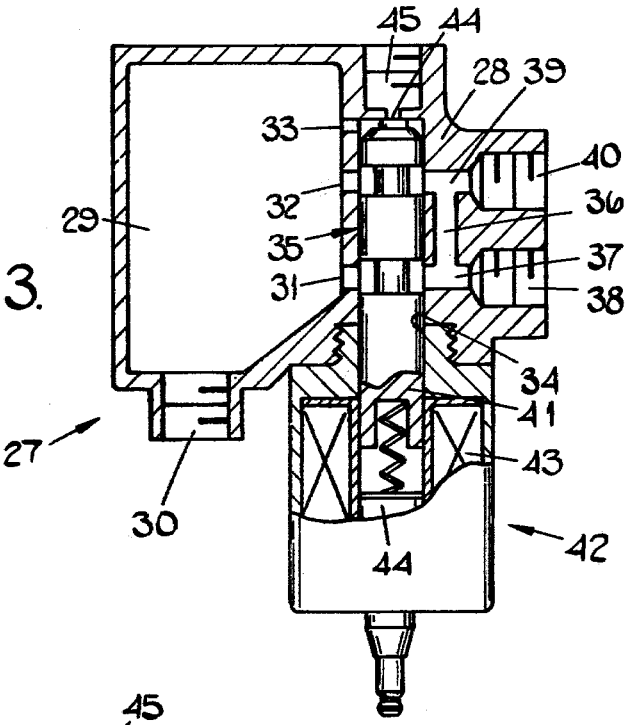
FIG. 3 is a sectional side view of a fuel supply device which forms part of the system of FIG. 1 with a valve means thereof in a first position.
Figure 4:
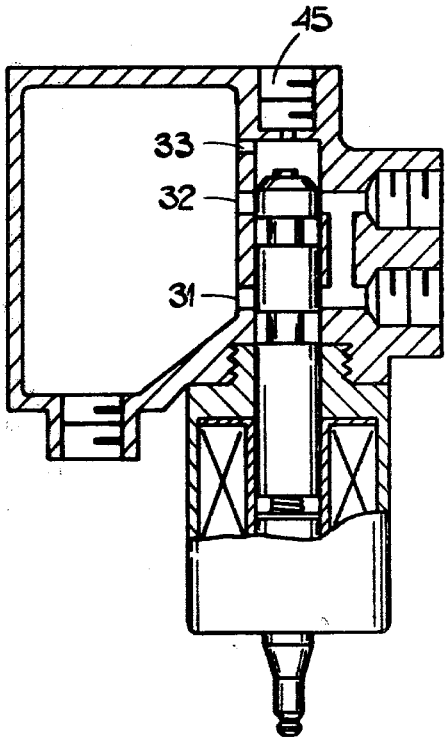
FIG. 4 is a view similar to FIG. 3 with the valve means in a second position.

The fuel supply device 27 is seen in sectional side elevation in FIGS. 3 and 4 and referring to FIG. 3 the device includes a body 28 within which is defined a chamber 29 which in use, is partly filled with liquid fuel. An outlet 30 extends from the lower end of the chamber and is connected to the inlet 19 of the starting aid.

Formed in one side wall of the chamber are three ports 31, 32 and 33. The ports open into a bore 34 defined in the body and accommodating a slidable spool valve 35. Moreover, the ports 31 and 32 have passages in register therewith and extending from the bore 34 at diametrically opposed positions. These two passages are interconnected by a by-pass passage 36 and the passage 37 which is in register with the port 31, communicates with an inlet 38 and this is in communication with a source of fuel. The passage 39 which is in register with the port 32 communicates with an outlet 40 and which is connected to a return pipe to the tank 15.

The source of fuel which supplies fuel to the inlet 38 is conveniently formed by the injection nozzles 14 which each have an outlet through which any fuel leaking within the nozzle unit can flow to a drain. The outlets of the nozzle units are therefore in practice connected together and to inlet 38.

The spool valve 35 is provided with a pair of spaced grooves the spacing of which is substantially equal to the spacing between the ports 31 and 32. Conveniently, one end of the spool forms an armature portion 41 and which is positioned to be under the influence of the magnetic field created by a solenoid 42 which includes a winding 43. As shown, a coiled compression spring is provided within an abutment 44 within the solenoid and a bore in the spool, and this acts in the de-energised state of the solenoid to urge the spool to a so-called first position in which the lands on the spool are in register with the ports 31 and 32 respectively.

The opposite end of the spool constitutes a closure member for a port 45 which is formed in the end of the bore 34 and which is connected to an inlet 45. The inlet 45 is connected to a tapping on the inlet manifold of the engine conveniently at a position upstream of the starting aid.

In the position shown in FIG. 3, the solenoid is de-energised as also will be the heating element of the starting aid. Assuming that the engine is running, then the leakage fuel will flow through the inlet 38 and the port 31 into the chamber 29 and the level of fuel in this chamber will rise up to the lowermost level of the port 32. When this level has been achieved the surplus fuel will flow by way of the outlet 40 to the tank 15. Moreover, it should be noted that the port 44 is closed and therefore the pressure within the fuel supply chamber 29 will be substantially atmospheric pressure.

When the engine is stopped and before any attempt is made to start the engine, the spool valve 35 will be in the position in which it is shown in FIG. 3. When, however, it is required to start the engine and the engine is sufficiently cold to warrant using the starting aid, the solenoid 42 is energised as also will be the heating element of the starting aid. The spool now moves to the position in which it is shown in FIG. 4 and it will be seen that the ports 31 and 32 are effectively closed by the lands of the spool. In addition, it will be noted that the port 33 is now in communication with the inlet 45. Fuel can therefore flow to the starting aid but the flow of fuel depends on whether the ball 21 has been allowed to move out of contact with the seating 20. Because of the thermal inertia of the starting aid this does take a period of time but when the ball is moved away from the seating fuel flows through the inlet 19 and is vapourised and ignited as described. When the flame is established cranking of the engine can take place and the heated air which flows to the engine facilitates the starting of the engine. Initially, the turbo-charger will be inoperative but as the engine speeds up, the turbo-charger will start to deliver air under pressure to the manifold 12. At the same time, however, it may still be necessary to maintain the starting aid in operation and the fact that communication between the inlet 45 and the port 33 is established the fuel will still flow to the starting aid under the action of gravity, the air pressure within the chamber 29 being the same as that which exists in the air inlet manifold 12.

The flow of fuel to the starting aid will continue so long as fuel remains in the chamber and the starting aid is energised. When the starting aid and the solenoid are de-energized, the spool 35 returns to the position in which it is shown in FIG. 3 and the chamber 29 is recharged with fuel as described. As previously explained, when the spool is in the first position the air pressure within the chamber 29 is substantially atmospheric pressure.

By providing the connection between the chamber 29 and the inlet manifold 12, the fuel supply device is able to supply fuel to a turbo-charged engine even when the turbo-charger is operative to pressurise the air flowing in the air inlet manifold of the engine.

I claim:

1. An internal combustion engine including a starting aid system, the starting aid system comprising a starting aid device mounted on an air inlet manifold of the engine and including a fuel inlet, a fuel outlet to which in use fuel can flow from the fuel inlet to be admitted to said inlet manifold and means for vapourising and igniting the fuel flowing through the fuel outlet, a fuel supply device including a fuel chamber having an air inlet connected to said inlet manifold, a fuel inlet adapted to be connected to a fuel source, a fuel outlet connected to the fuel inlet of the starting aid device and valve means arranged to control communication between the air inlet, the fuel inlet and the fuel chamber, the valve means in a first position permitting communication between the fuel inlet and the fuel chamber but closing communication between the air inlet and the fuel chamber, and in a second position permitting communication between the air inlet and the fuel chamber so that air pressure in said inlet manifold is communicated to the fuel chamber but closing communication between the fuel inlet and the fuel chamber, and further valve means arranged to control communication between the fuel chamber of the fuel supply device and the fuel outlet of the starting aid device such that communication therebetween is permitted when the first mentioned valve means in its second position.

2. An engine according to claim 1 in which said further valve means forms part of the starting aid device and is arranged to control communication between the fuel inlet and the fuel outlet thereof.

3. An engine according to claim 1 or claim 2 in which the air in said inlet manifold is pressurized by means of a compressor which may be in the form of a turbocharger powered by exhaust gases flowing in an exhaust manifold of said engine.

4. An engine according to claim 1 including injection nozzles through which fuel is supplied to the combustion chambers respectively of the engine, said source of fuel comprising the leakage outlets of said injection nozzles.

5. An engine according to claim 2 in which said further valve means is opened to permit fuel flow when the starting aid device is supplied with electric current, said first mentioned valve means also being operated electrically and being arranged when electric current is supplied to the starting aid device to be moved from the first to the second position.

6. An engine according to claim 4 including a further outlet from said chamber, said further outlet being disposed at a level above said fuel inlet, said further outlet in use being connected to a drain.

7. An engine according to claim 6 in which said first mentioned valve means when in said second position act to allow the fuel supplied to said inlet to flow through the further outlet.

8. A fuel supply device for an internal combustion engine starting aid and comprising a fuel chamber having a first inlet for connection to an inlet manifold of said engine, a second inlet for connection to a fuel source and an outlet for connection to said starting aid, valve means for controlling communication between the inlet and the fuel chamber, the valve means in a first position permitting communication between the second inlet and the fuel chamber but preventing communication between the first inlet and the fuel chamber and in a second position permitting communication between the first inlet and the fuel chamber but preventing communication between the second inlet and the fuel chamber.

9. A fuel supply device according to claim 8 in which the fuel chamber has a further outlet and the valve means is arranged also to control communication between the further outlet and the fuel chamber so that such communication is permitted when the valve means is in its first position but is prevented when the valve means is in its second position, the further outlet being disposed above the second inlet when the fuel chamber is in use.

10. A fuel supply device according to claim 9 in which the second inlet and the further outlet are connected together by means of a passage in a body which defines the fuel chamber, said passage by-passing the valve means.

11. A fuel supply device according to claim 8 in which the body is formed in two parts, the fuel chamber, the inlets and outlets being provided in one part and the other part having an actuator for the valve means.

12. A fuel supply device according to claim 11 including a further body secured to the first mentioned body and mounting a solenoid winding which when energised moves the spool axially against the action of resilient means.

* * * * *